US005368085A

United States Patent [19]

Ruparelia

[11] Patent Number: 5,368,085

[45] Date of Patent: Nov. 29, 1994

[54] RESUABLE INSULATING SHEATH FOR WINDOWS

[76] Inventor: Shilpa S. Ruparelia, 42 Jellicoe Gardens, Stanmore, Middx., England

[21] Appl. No.: 15,532

[22] Filed: Feb. 9, 1993

[51] Int. Cl.[5] ..... E06B 3/80

[52] U.S. Cl. ..... 160/327; 160/368.1; 160/391; 160/354; 160/180

[58] Field of Search ..... 160/180, 368.1, 354, 160/327, 380, 391

[56] References Cited

U.S. PATENT DOCUMENTS

| | | | |
|---|---|---|---|
| 2,391,871 | 1/1946 | Benson | 160/368.1 |
| 3,251,399 | 5/1966 | Grossman | 160/354 X |
| 4,220,298 | 9/1980 | Willis | 160/368.1 X |
| 4,232,310 | 11/1980 | Wilson | 160/380 X |
| 4,410,027 | 10/1983 | Lucous | 160/380 |
| 4,453,585 | 6/1984 | Ruggeberg, Sr. et al. | 160/380 X |
| 5,214,891 | 6/1993 | Edlin | 160/327 X |

*Primary Examiner*—Blair M. Johnson
*Attorney, Agent, or Firm*—Hugh E. Smith

[57] ABSTRACT

A flexible and reusable plastic window covering is designed to be selectively attached over an existing window opening to reduce or eliminate air leakage and drafts. Either hook and loop fasteners or locking strips can be used to attach the plastic sheath over a window opening and, if desired, the sheath can be provided with a zipper to allow air flow through the window. Special locking strips can be used to securely attach the flexible sheath over a window opening while facilitating an easy removal when required.

5 Claims, 5 Drawing Sheets

RESUABLE INSULATING SHEATH FOR WINDOWS

BACKGROUND OF THE INVENTION

1. Field of the Invention

The present invention relates to window coverings, and more particularly pertains to an insulating sheath which is of a flexible and reusable construction and which may be utilized to reduce air leakage through a window opening.

2. Description of the Prior Art

The use of flexible window coverings is known in the prior art. At the present time, flexible plastic may be purchased commercially for the purpose of covering window openings. This is especially desirable during periods of extreme temperature. More particularly, flexible plastic which is sealed over a window opening reduces the loss of air conditioning during hot summer months while retaining heat within a structure during the cold winter season. While these types of window coverings are known in the prior art, there are no commercially available connectors which facilitate an easy and efficient attachment of such plastic sheathing over a window opening. Usually, a user must nail, staple, glue, tape, or utilize some other known conventional means of attaching the plastic sheathing over a window and quite frequently, substantial air leakage still exists after the plastic is in place. Accordingly, it can be appreciated that there exists a continuing need for new and improved means for attaching such plastic sheathing over a window opening and in this regard, the present invention substantially fulfills this need.

SUMMARY OF THE INVENTION

In view of the foregoing disadvantages inherent in the known types of window coverings now present in the prior art, the present invention provides an improved insulative window covering construction wherein the same can be easily and efficiently attached over an existing window opening so as to provide added protection against air leakage both into and out of an enclosed structure. As such, the general purpose of the present invention, which will be described subsequently in greater detail, is to provide a new and improved reusable insulating sheath for windows which has all the advantages of the prior art insulating sheaths and none of the disadvantages.

To attain this, the present invention essentially comprises a flexible and reusable plastic window covering which is designed to be selectively attached over an existing window opening to reduce or eliminate air leakage and drafts. Either hook and loop fasteners or locking strips can be used to attach the plastic sheath over a window opening and, if desired, the sheath can be provided with a zipper to allow air flow through the window. Special locking strips can be used to securely attach the flexible sheath over a window opening while facilitating an easy removal when required.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reusable insulating sheath for windows which has all the advantages of the prior art reusable insulating sheaths for windows and none of the disadvantages.

It is another object of the present invention to provide a new and improved reusable insulating sheath for windows which may be easily and efficiently manufactured and marketed.

It is a further object of the present invention to provide a new and improved reusable insulating sheath for windows which is of a durable and reliable construction.

An even further object of the present invention is to provide a new and improved reusable insulating sheath for windows which is susceptible of a low cost of manufacture with regard to both materials and labor, and which accordingly is then susceptible of low prices of sale to the consuming public, thereby making such reusable insulating sheaths for windows economically available to the buying public.

Still yet another object of the present invention is to provide a new and improved reusable insulating sheath for windows which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
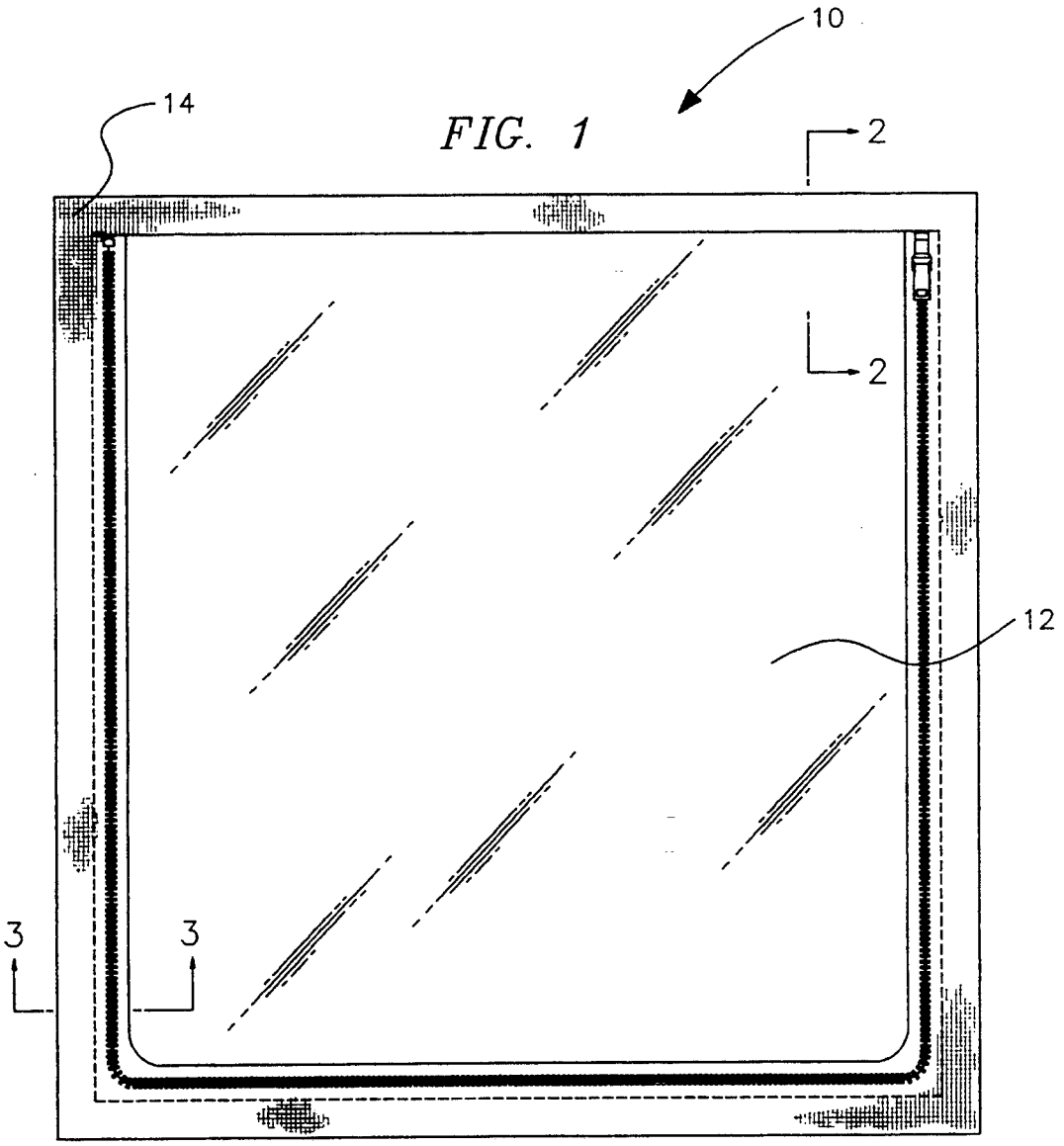
FIG. 1 is a front elevation view of the reusable insulating sheath for windows comprising the present invention.
Figure 2:
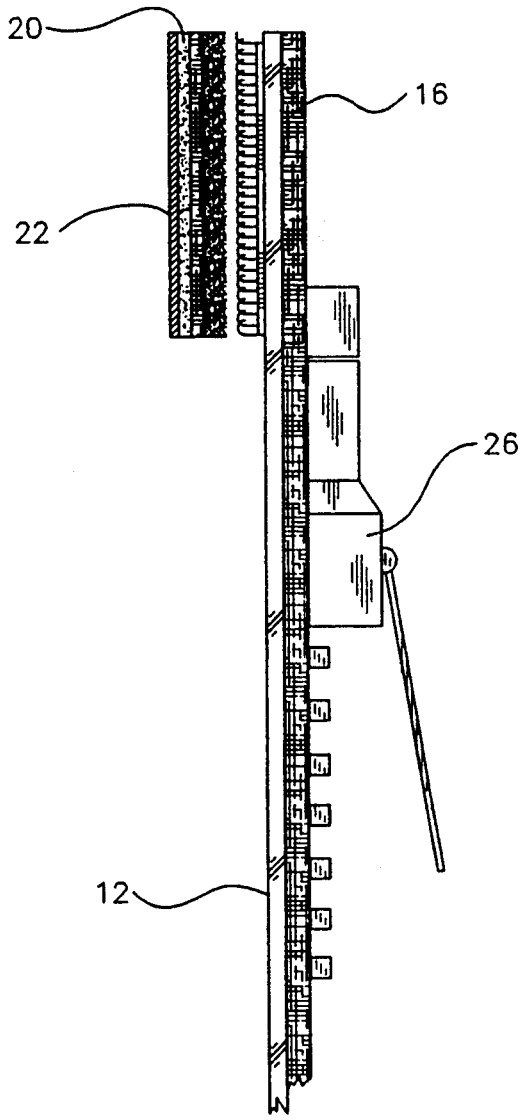
FIG. 2 is a cross-sectional view as viewed along the line 2—2 in FIG. 1.
Figure 3:
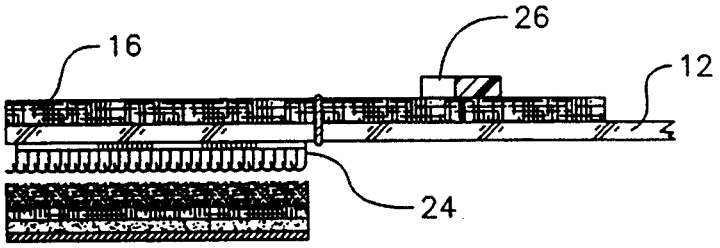
FIG. 3 is a cross-sectional view as viewed along the line 3—3 in FIG. 1.

With reference now to the drawings, and in particular to FIGS. 1–4 thereof, a new and improved reusable insulating sheath for windows embodying the principles and concepts of the present invention and generally designated by the reference numeral 10 will be described.

Figure 4:
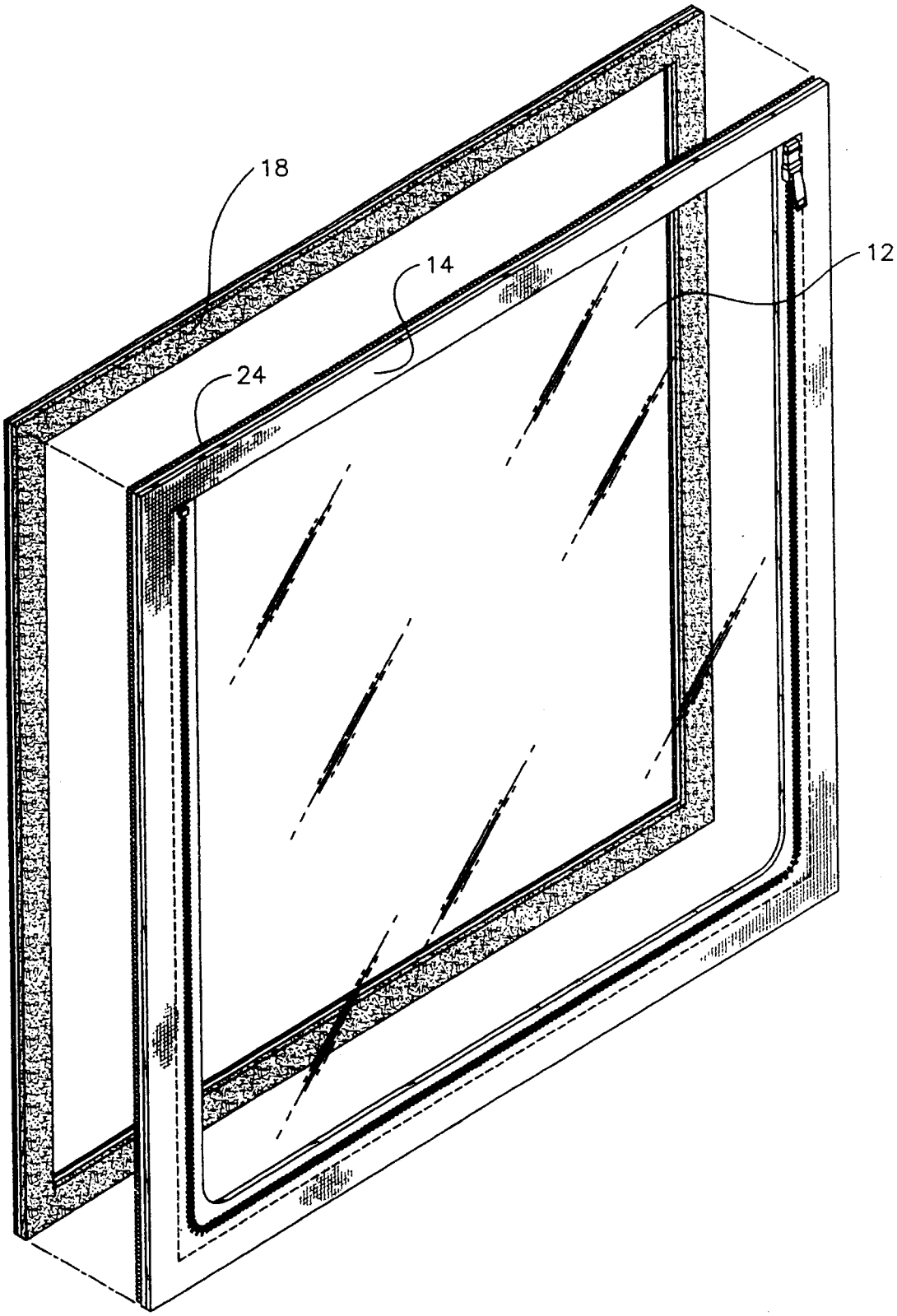
FIG. 4 is an isometric view of the invention.

More specifically, it will be seen that the reusable insulating sheath 10 essentially comprises a rectangularly-shaped sheet of transparent, flexible sheeting 12 positionable over an existing window opening as desired. Of course, the plastic sheath 12 may be manufactured in any desired shape and could be provided by special order to fit virtually any known type and shape of commercially available window structure. As such, the plastic sheath 12 shown in FIGS. 1 and 4 is for illustrative purposes only, and it is to be understood that any shape and size of such sheath could be provided to the consuming public.

With further reference to FIGS. 1–4, sheath 12 is illustrated as having a reinforced edge structure 14 to provide additional strength as required. This reinforced edge 14 could be achieved by a number of different means, to include thickening the edge to a greater extent than a central transparent portion of the sheet 12 or otherwise embedding a layer of mesh or independent fiber materials within the plastic. This embedded mesh or fiber 16 would reduce the transparency of the sheath 12; however, since the embedded mesh or fibers would be provided only around the edge 14 of the sheath, no loss of transparency through the viewing section thereof would be apparent. In the case of utilizing independent fibers 16, one embodiment envisions the use of metallic fibers of a ferrous construction, thereby to provide additional strength to the edge 14 as well as to be magnetizable or attracted to a magnetic structure as will be subsequently described in greater detail.

To attach the transparent sheet 12 over a window opening, a hook and loop fastening means is utilized. In this respect, strips of hook fasteners 18 provided with a tape attachment means 20 can be positioned around a peripheral edge of an existing window opening. The tape 20 is provided with a removable backing 22 so as to expose the adhesive surface of the hook material 18, thereby to facilitate a conventional attaching of the material around the window. Similarly, a loop fastener strip 24 is adhesively attached around the peripheral edge 14 of the sheet 12 in a manner which allows its precise alignment with the existing hook material 18. As is now apparent, the sheath 12 can be easily attached by the hook and loop fasteners 18, 24 over an existing window opening, and can just as easily be removed when desired. Recognizing that it is somewhat cumbersome to selectively remove and reattach the sheath 12 over an existing window opening through the use of the hook and loop fastening means 18, 24, the sheath may be provided with a zipper structure 26 which allows an occasional opening of the sheath without its removal from the window. This zipper structure 26 could extend around the entire peripheral edge of the sheath 12, whereby a section thereof could be completely removed or, as shown in FIG. 4, it may extend only partially around to allow a partial opening of the sheath.

Figure 5:
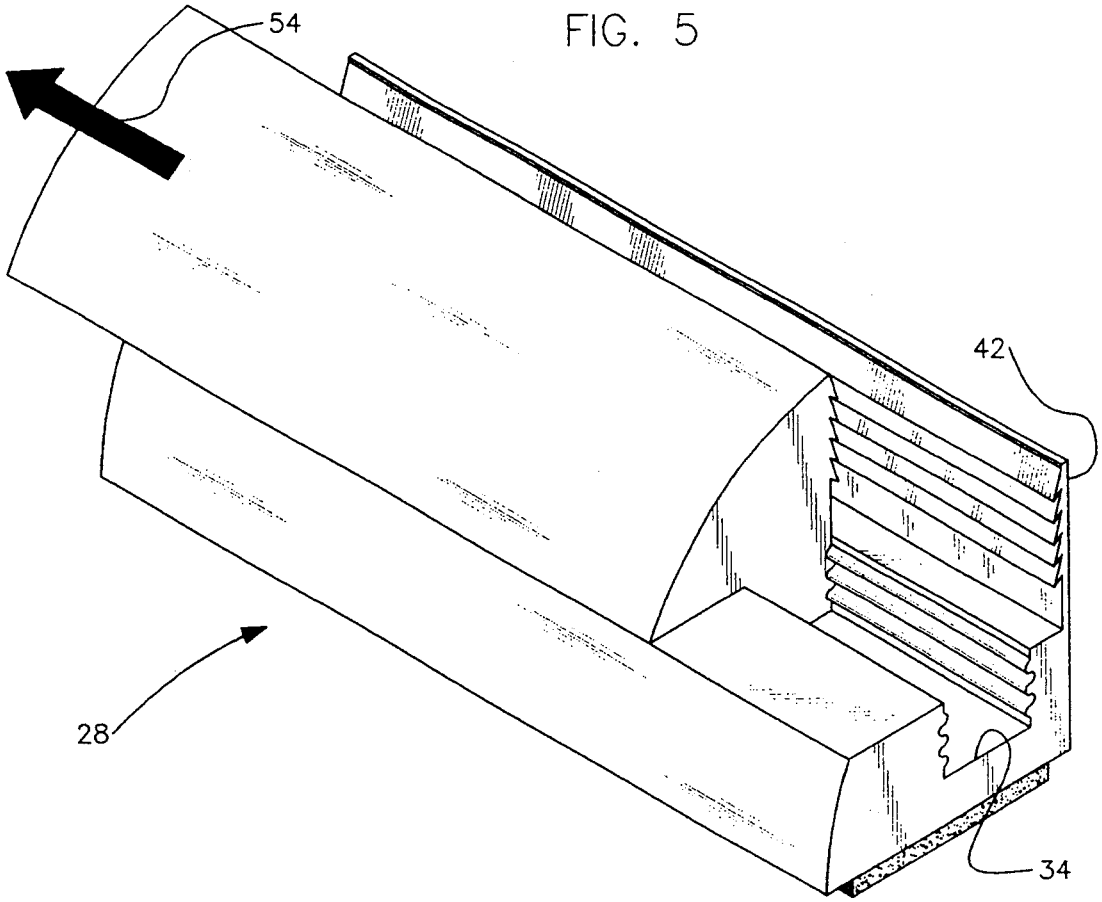
FIG. 5 is an isometric view of a modified connecting structure utilizable with the invention.
Figure 6:
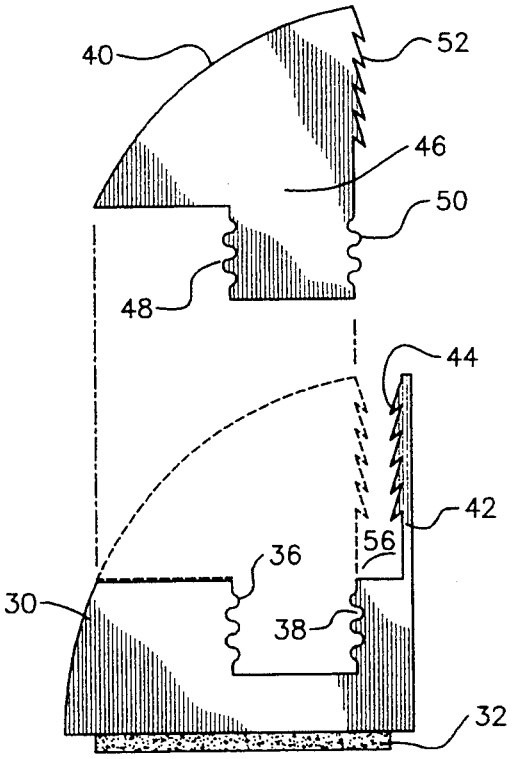
FIG. 6 is an exploded end elevation view of the modified connecting structure.

Alternative means for attaching the sheath 12 over a window opening is shown in FIGS. 5 and 6. This alternative embodiment of connecting means which is generally designated by the reference numeral 28 includes a base member 30 having a strip of outdoor double backed tape 32 secured to a bottom surface thereof. A base member 30 is utilized to replace the hook fasteners 18 as shown in FIG. 4, whereby the base extends completely around the existing window opening, and the base includes an internal axially aligned slot 34 having first locking grooves 36 on one side of the slot and second locking grooves 38 on an opposed side of the slot. The locking grooves 36, 38 extend the entire length of the slot 34 and are designed to assist in the retention of the locking insert 40 which will be subsequently described in greater detail. Base 30 further includes an upstanding wall portion 42 which is integrally a part of the base and which includes a plurality of downwardly extending, integral teeth 44 designed to grip a sheath 12.

FIGS. 5 and 6 further illustrate the aforementioned locking insert 40 which is of an elongated construction and which is designed to engage the base 30 so as to retain a sheath 12 in position over a window opening. The locking insert 40 includes a downwardly extending leg portion 46 having continuous, axially aligned notches 48, 50 on opposed external surfaces thereof. Additionally, on a rear surface of the locking insert 40, downwardly extending teeth members 52 are integrally formed thereon and extend over the entire length of the locking insert.

In use, the base member 30 is attached around the periphery of a window opening by means of the outdoor double backed tape 32. When so positioned, a sheath 12 of transparent plastic is positioned against the upstanding wall member 42 and pressed into engagement with the downwardly extending teeth 44. A locking insert 40 is then slid into the slot 34 in the direction of the arrow 54 so as to effectively cause a gripping of the sheath 12 between the upstanding wall member 42 and the teeth 52 formed on the locking insert. As is now apparent, the locking notches 48, 50 are respectively engageable with and retained within the locking grooves 36, 38 whereby the locking insert 40 cannot be removed from the base 30. At the same time, the downwardly extending teeth 52 on the locking insert 40 and the downwardly extending teeth 44 on the upstanding wall member 42 effectively grip and retain the plastic sheath 12 in engagement within the slot 56 defined between the locking insert and the upstanding wall member. With this type of connection achieved around the entire peripheral edge 14 of a window covering sheath 12, a sealed and firm gripping thereof over a window opening is achieved.

Figure 7:
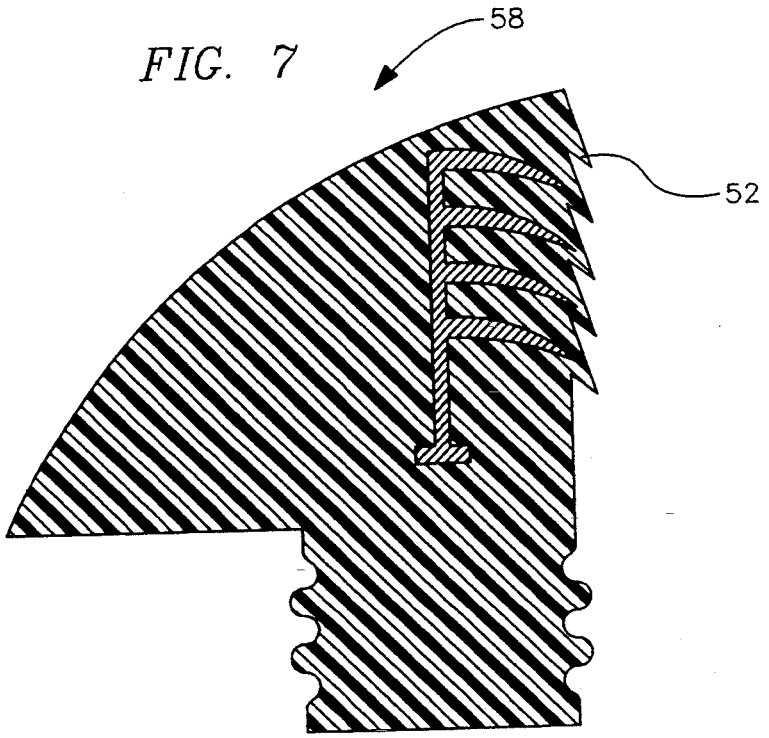
FIG. 7 is an end elevation view of a modified locking insert used with the connecting structure shown in FIG. 5.
Figure 8:
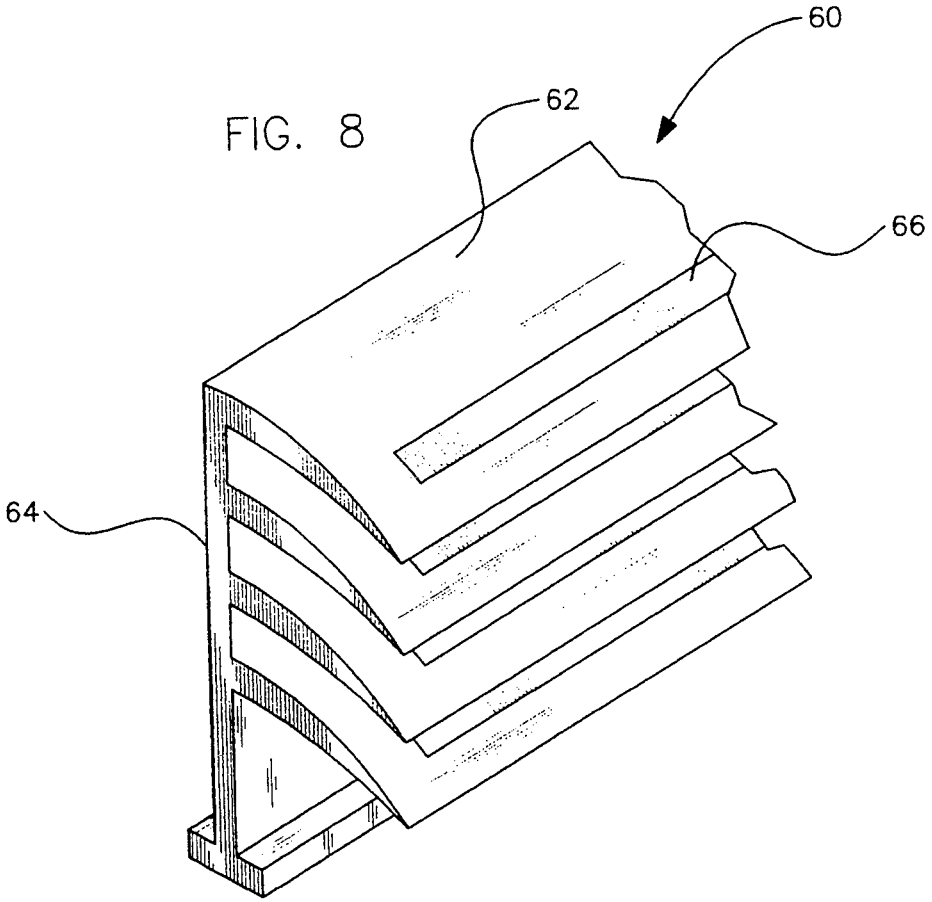
FIG. 8 is an isometric view of a rigid spring structure utilized in the modified locking insert shown in FIG. 7.

FIGS. 7 and 8 illustrate a further modified embodiment of the invention which is essentially a modified embodiment of the locking insert 40 illustrated in FIGS. 5 and 6. This modified embodiment of locking insert is generally designated by the reference numeral 58. As shown, the locking insert 58 is identical in all respects to locking insert 40 shown in FIGS. 5 and 6 with the exception that a stiffening spring member 60 is molded within the structure of the locking insert. Recognizing that the locking insert 58 might be of a somewhat flexible construction in some cases, such as being manufactured from flexible rubber or plastic, it is desirable in those cases to provide some rigidity to the downwardly extending teeth 52. This is particularly important when substantial pressure differentials might be experienced over a window opening whereby the sheath 12 might be pulled out of the slot 56 as shown in FIG. 6. When the locking insert 58 is manufactured from a flexible rubber or plastic material, the teeth 52 could yield upwardly so as to release their grip on a sheath 12 and to prevent this, a metal spring tree 60 is integrally molded within the structure of the locking insert 58.

As best illustrated in FIG. 8, the locking spring tree 60 could have any number of downwardly extending leaves 62 wherein each of these leaves are integrally or otherwise attached to a flat plate member 64. With proper positioning within the insert 58, the leaves would limit upward flexing of the teeth 52 in a now apparent manner. Additionally, in those cases where the edge structure 14 of a sheath 12 is reinforced with metallic fibers comprising a ferrous material, a plurality of small magnets 66 could be attached or otherwise formed within each leaf member 62. These magnets 66 would provide an even further gripping and sealing of a sheath 12 over a window opening inasmuch as the metallic fibers 16 would be magnetically attracted to the magnets 66 to achieve this additional gripping function.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new reusable insulating sheath selectively positionable over a window opening, said sheath comprising:

a flexible, transparent sheet of plastic;

a base member attachable to a perimeter of said window opening, said base member having an upstanding wall portion with at least one downwardly extending base tooth protecting from said upstanding wall portion;

a locking insert having a rear surface with at least one downwardly extending insert tooth projecting from said rear surface, wherein said at least one downwardly extending base tooth comprises a plurality of downwardly extending base teeth and said at least one downwardly extending insert tooth comprises a plurality of downwardly extending insert teeth; and coupling means for releasably coupling said locking insert to said base member, whereby a portion of said sheet may be captured between said base member and said locking insert to retain said sheet over said window opening; wherein said coupling means comprises an axially aligned slot integrally formed within said base member, said slot having first and second opposed sides with first locking grooves formed in said first side of said slot and second locking grooves formed in said second side of slot; and a leg portion integrally connected to said locking insert, said leg portion having axially aligned first and second notches on respectively opposed first and second external surfaces of said leg portion, wherein said first and second notches of said locking insert may be engaged to respective said first and second locking grooves formed in said base member.

2. The new reusable insulating sheath of claim 1, and further comprising a zipper means secured to said sheet for permitting said sheet to be at least partially removed from over said window opening without a disengagement of said locking insert from said base member.

3. The new reusable insulating sheath of claim 2, and further comprising reinforcing metallic fibers coupled to an edge of said sheet.

4. The new reusable insulating sheath of claim 3, and further comprising metallic stiffening means present within said locking insert for stiffening said insert teeth, said metallic stiffening means comprising at least one metallic member positioned proximate at least one of said insert teeth, thereby to limit a flexible movement of said at least one of said insert teeth.

5. The new reusable insulating sheath of claim 4, and further comprising at least one magnet coupled to said stiffening means, said at least one magnet being magnetically attracted to said reinforcing metallic fibers of said sheet, thereby to achieve an improved gripping function between said insert teeth and said sheet.

* * * * *